US008371902B2

(12) United States Patent
Sherwood

(10) Patent No.: US 8,371,902 B2
(45) Date of Patent: Feb. 12, 2013

(54) ADJUSTABLE PUSH-UP ADHESIVE BRA

(76) Inventor: Juliana Lutzi Sherwood, Glendale, CA (US)

( * ) Notice: Subject to any disclaimer, the term of this patent is extended or adjusted under 35 U.S.C. 154(b) by 257 days.

(21) Appl. No.: 12/917,088

(22) Filed: Nov. 1, 2010

(65) Prior Publication Data

US 2012/0108143 A1 May 3, 2012

(51) Int. Cl.
*A41C 3/00* (2006.01)

(52) U.S. Cl. ..... 450/58; 450/38; 450/54; 450/81

(58) Field of Classification Search ..... 450/36–39, 450/54–58, 1, 81, 86; 2/267, 268
See application file for complete search history.

(56) References Cited

U.S. PATENT DOCUMENTS

| | | | | |
|---|---|---|---|---|
| 4,992,074 | A | 2/1991 | Diaz | |
| 5,693,164 | A | 12/1997 | Chang | |
| 5,755,611 | A | 5/1998 | Noble et al. | |
| 5,971,834 | A | 10/1999 | Murray | |
| 6,224,458 | B1 * | 5/2001 | Chen | 450/57 |
| 6,645,042 | B2 * | 11/2003 | Davis | 450/88 |
| 6,758,720 | B2 | 7/2004 | Chen | |
| 6,780,081 | B2 * | 8/2004 | Chen et al. | 450/81 |
| 6,852,001 | B2 * | 2/2005 | Chen et al. | 450/57 |
| 6,857,932 | B2 | 2/2005 | Chen | |
| 6,916,224 | B2 * | 7/2005 | Chen et al. | 450/57 |
| 7,052,359 | B2 | 5/2006 | Chen et al. | |
| 7,144,296 | B2 | 12/2006 | Chen et al. | |
| 7,163,605 | B2 | 1/2007 | Chen | |
| 7,229,335 | B2 | 6/2007 | Davis | |
| 7,267,599 | B2 | 9/2007 | Allen et al. | |
| 7,278,899 | B2 | 10/2007 | Davis | |
| 7,677,952 | B2 | 3/2010 | Wooley | |
| 8,221,189 | B2 * | 7/2012 | Chen et al. | 450/81 |
| 2010/0029176 | A1 * | 2/2010 | Chen et al. | 450/38 |

* cited by examiner

*Primary Examiner* — Gloria Hale
(74) *Attorney, Agent, or Firm* — Marc Martino

(57) ABSTRACT

The push-up adhesive bra includes a pair of bra cups each comprising a generally concave inside surface opposite a generally convex outside surface. Each cup defines an eye-shaped perimeter including a generally curved top and bottom edge meeting at an inner and outer peak. An adhesive is disposed along a portion of the inside surface for removably adhering the bra to a pair of woman's breasts when worn. A two-piece connector is individually fixed to each cup and engagedly connects the pair of cups and is configured such that the connector is disposed substantially at or below a bottom breast line when worn. A shelf-like padding is disposed within each cup adjacent to the bottom edge generally disposed below the woman's breasts. The top edge of each cup comprises a plurality of strap engagement receiving slots where a strap can be selectively attached at any one of the slots.

20 Claims, 5 Drawing Sheets

ADJUSTABLE PUSH-UP ADHESIVE BRA

FIELD OF THE INVENTION

The present invention generally relates to bras. More particularly, the present invention relates to an adjustable push-up adhesive bra.

BACKGROUND OF THE INVENTION

A brassiere/bra is an article of clothing that covers, supports, and elevates the breasts. Since the late 19th century, it has replaced the corset as the most widely accepted method for supporting a woman's breasts. Women wear bras for a variety of purposes. For example as support or to improve the shape of breasts, to reduce or to enlarge the perceived breast size, to restrain breast movement during an activity such as exercise, or to enhance their cleavage or to facilitate nursing. Most bras are designed to be form-fitting and to lift the breasts off the chest wall if they sag and to restrain their movement. Bra designers strive to produce a garment that is both functional and aesthetically pleasing.

The term "brassiere" seems to have come into use in the English language as early as 1893. Manufacturers were using the term by about 1904 and Vogue magazine first used it in 1907. By 1911 the word had made its way into the Oxford English Dictionary. In the 1930s, "brassiere" gradually came to be shortened to "bra." On Nov. 13, 1914, the newly formed U.S. patent category for "brassieres" was inaugurated with a patent issued to Mary Phelps Jacob. Even today, the designs of bras are still evolving and changing as is evidenced with this application and many others.

Bra designs may change due to the use of new technologies or from an increased pressure from changing women's fashion. Today, fashionable clothing for women often includes low-cut/plunging necklines, backless, and or strapless designs. Accordingly, a traditional style bra would not function appropriately and other bra designs must be utilized. To this end many bra designs are strapless/backless bras which use an adhesive to adhere directly to the skin of the breast themselves. This design eliminates the need for a strap spanning around either the back of the woman or around her neck.

Unfortunately, a strapless adhesive bra doesn't provide much of the support and comfort of a traditional bra. Additionally, some women may want to selectively position an auxiliary strap to match the silhouette of a particular dress or outfit they are wearing, or simply for increased support. Additionally, many women want a padded bra which also enhances the look of their breast such that it appears fuller and with more cleavage.

Currently, the typical push-up adhesive bra doesn't provide an adequate amount of support while enhancing the look of the cleavage and bust. More specifically, many adhesive bras simply pull each breast toward the other. This sideways pull poorly simulates the affect of an increased cleavage and bust. Pulling the breasts sideways and towards each other is not as effective as pushing them upwardly in addition to inwardly. Also problematic, adhesive bras are thin and are not constructed to give proper support. It is common for the breast to overflow the bottom or outside edge of the adhesive bra. These situations are less than ideal and not only lead to discomfort but are aesthetically unpleasing.

Additionally, an adhesive style bra uses a connector placed directly within the area of cleavage. This means that a deep plunging neckline free of connectors/obstacles cannot be obtained, as the connector is directly in the way. Also, bras which have attachable straps only provide one such location for attachment. This means that the woman cannot selectively choose how or where she prefers her attachment. If the use of an auxiliary strap is desired, it is hard to match it to the structure and variations of each particular dress/outfit such that the strap is hidden.

Accordingly, there is a need for a push-up adhesive bra that fits better, creates a bigger and fuller cleavage, has internal rigidity and support, and allows one to position it in a multitude of ways with the use of an auxiliary and a selectively positionable strap. The present invention fulfills these needs and provides other related advantages.

SUMMARY OF THE INVENTION

The push-up adhesive bra of the present invention includes a pair of bra cups. Each cup comprises a generally concave inside surface opposite a generally convex outside surface. Each cup also defines a perimeter including a generally curved bottom edge and a generally curved top edge. The perimeter is generally eye-shaped where the curved top edge and bottom edge meet at an inner peak and an outer peak.

An adhesive is disposed along a portion of the inside surface of each cup for removably adhering the bra to a pair of a woman's breasts when worn. The adhesive can be directly applied to the inside surface of the bra either during manufacture or at a later time directly before use. For instance in one embodiment a spray-on adhesive may be utilized, or alternatively, a double-sided tape may be used to temporarily attach the bra in position.

A two-piece connector is individually fixed to each cup and engagedly connects the pair of cups thereby forming the bra. The cups and connector are configured such that the connector is disposed substantially at or below a bottom breast line of the pair of the woman's breasts when worn. By placing the connector at or below the bottom breast line, it forces each cup and the corresponding breast in an upwardly and inwardly direction.

The connector engagedly connecting the pair of cups is resiliently and flexibly configured to angularly bias the cups to increase an angle between each curved top edge. Therefore, when the bra is worn it forces each cup and corresponding breast in an upwardly and inwardly direction. This bias increases cleavage and gives a better appearance of an increased bust. In one embodiment, the connector is disposed at an intersection of the top edge and bottom edge wherein the connector is aligned with the top edge. This alignment forces the angular bias when the bra is worn.

A shelf-like padding is disposed within each cup adjacent to the bottom edge and is generally disposed below the woman's breasts when worn. The breasts rest substantially above the padding to help enhance the overall look for a bustier appearance.

A substantially flat inside surface area of the bra can be defined which rests just below the woman's breast when the bra is in place. The area is defined encompassing the area between the curved bottom edge spanning the inner and outer peaks and between a straight line drawn spanning the inner and outer peaks. This straight line coincides with the bottom breast line when worn. The substantially flat area forms a support below the woman's breast. The inward curve of the shelf-like padding starts at the straight line, which padding then thins as it reaches towards the curved top edge.

In one embodiment the top edge of each cup comprises at least two strap engagement receiving slots. In another embodiment, the top edge of each cup comprises a plurality of strap engagement receiving slots. A strap can be selectively attached at one of the plurality of the strap engagement receiving slots. This enables one to wear the push-up adhesive bra in a plurality of methods and styles to match corresponding outfits or individual preferences. In one embodiment the strap engagement receiving slots are formed by a selectively discontinuous upper seam along the top edge. To keep a slim and sleek appearance at the top of the bra line, the top edge can be no more than 3 mm in thickness. The strap also comprises a hook feature for engaging with the strap engagement receiving slots. Similarly, to keep a sleek appearance, the hook feature of the strap can be no more than 3 mm in thickness. For strength and support, the hook feature of the strap in one embodiment can be metallic.

In another embodiment the bottom edge of each cup comprises a resiliently rigid seam. The resiliently rigid seam can comprise a sewn overlapping fabric which provides a resiliently rigid seam structure. The rigid seam provides support without the use of an underwire.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 2:
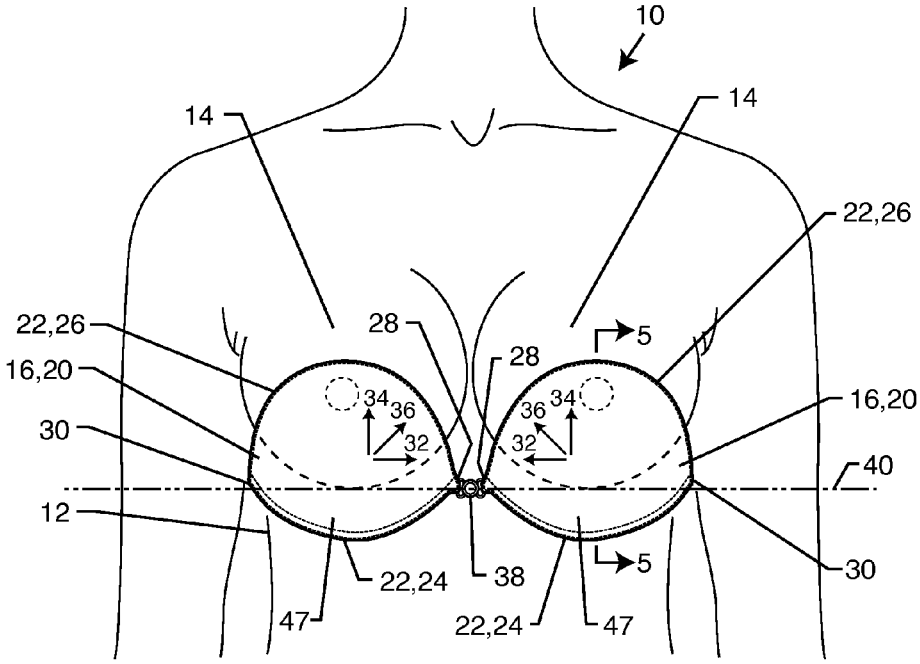
FIG. 2 is a front view of an exemplary adjustable push-up adhesive bra embodying the present invention while being worn.

As shown in the drawings for purposes of illustration, the present invention for an adjustable push-up adhesive bra is referred to generally by the reference number 10. In FIG. 2, the adjustable push-up adhesive bra 10 is shown being worn by a woman 12. The woman 12 has a pair of breasts 14 which are supported by the bra 10. The bra 10 includes a pair of bra cups 16. Each cup 16 comprises a generally concave inside surface 18 opposite a generally convex outside surface 20. Each cup also defines a perimeter 22 including a generally curved bottom edge 24 and a generally curved top edge 26. The perimeter 22 is generally described as eye-shaped where the curved bottom edge 24 and curved top edge 26 meet at an inner peak 28 and at an outer peak 30.

Figure 1:
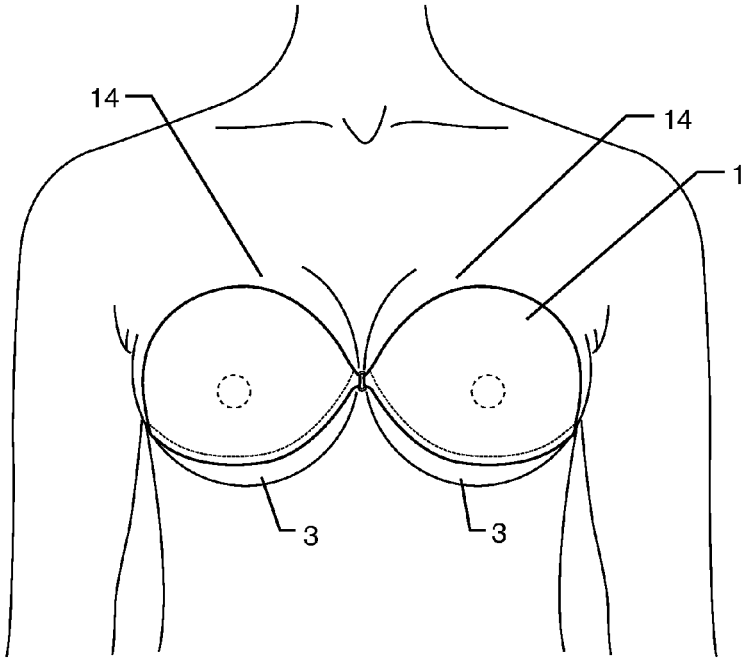
FIG. 1 PRIOR ART
FIG. 1 is a front view of a prior art adhesive bra.

FIG. 1 is a front view of a prior art adhesive bra 1. FIG. 1 can be contrasted with FIGS. 2-10 to show the differences between the present invention and the prior art. The prior art adhesive bra 1 is adhered to each breast 14 and pulls each breast 14 toward the other. Accordingly, the breasts 14 are pulled sideways towards one another and not up. This results in an undesirable portion of lower breast 3 which can be seen hanging below the bra 1. Furthermore, the bra 1 does nothing to add lift or support to each breast 14.

FIG. 2 shows how this embodiment of the adjustable push-up adhesive bra 10 supports the breasts 14 by pushing them not only in an inwardly direction 32, but also in an upwardly direction 34. Both the inwardly 32 and upwardly 34 directions are combined into an angled direction 36 which results in better cleavage and bust appearance as compared to the prior art bra 1. The adjustable push-up adhesive bra 10 has eliminated the undesirable portion of the lower breast 3 from hanging below. Furthermore, the adjustable push-up adhesive bra 10 also provides support to prevent the breasts from sagging and developing ptosis.

A two-piece connector 38 is individually fixed to each cup 16 and engagedly connects the pair of cups 16 thereby forming the bra 10. The cups 16 and connector 38 are configured such that the connector 38 is disposed substantially at or below a bottom breast line 40 of the pair of the woman's breasts 14 when worn. By placing the connector 38 at or below the bottom breast line 40, it forces each cup 16 and the corresponding breast 14 in an upwardly 34 and inwardly 32 direction. Also, by placing the connector 38 at or below the bottom breast line 40, it allows the woman 12 to wear deep plunging and low cut necklines. The prior art adhesive bra 1 was incapable of being worn with such low cut necklines.

Figure 3:
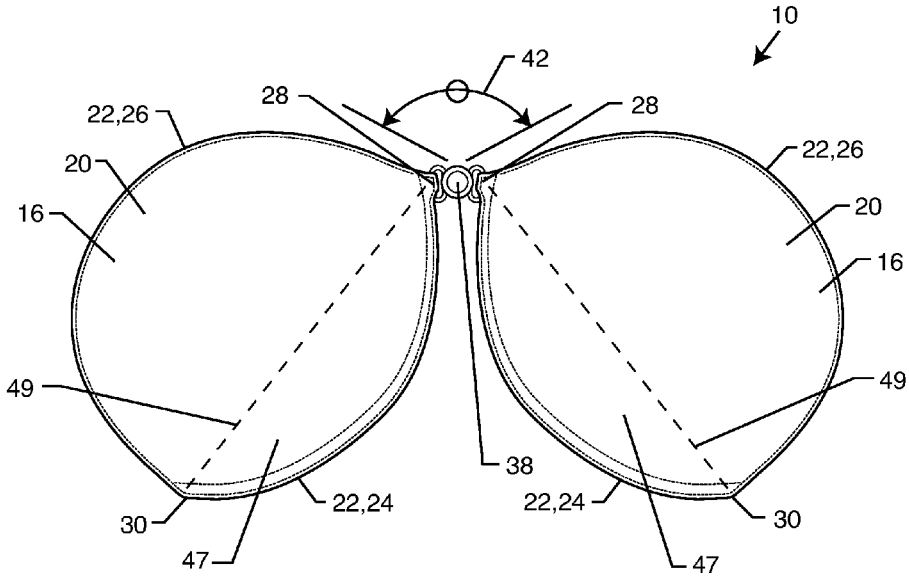
FIG. 3 is a front view of the structure of FIG. 1 while not being worn now showing an angular bias.
Figure 4:
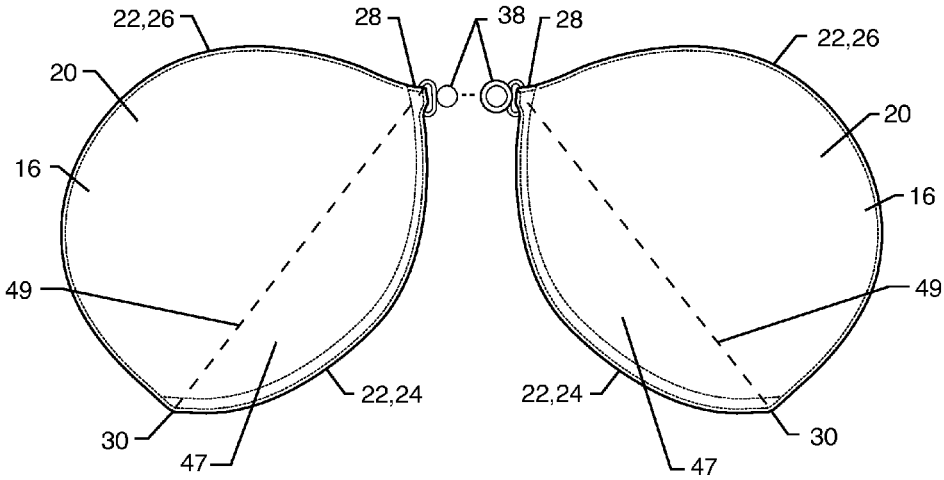
FIG. 4 is a view similar to the structure of FIG. 3 now showing each cup separated from the other.

The connector 38 engagedly connecting the pair of cups 16 is also resiliently and flexibly configured to angularly bias the cups 16 to increase an angle 42 between each curved top edge 26 as shown in FIG. 3. FIG. 3 is a front view of the structure of FIG. 1 not being worn and showing the angular bias. When the bra 10 is worn, the angular bias helps force each cup 16 and corresponding breast 14 in an inwardly 32 and upwardly 34 direction. This bias increases cleavage and gives a better appearance of a larger bust while also providing further support. In these embodiments, the connector 38 can be described as being disposed at an intersection of the top edge 26 and bottom edge 24 where the connector 38 is aligned with the top edge 26 as is illustrated in FIG. 4. It is this alignment which helps force the angular bias when the bra 10 is worn. As can be seen, there are a multitude of techniques and methods for creating such an angular bias. For instance, springs, flexures, and flexibly biased joints and supports may be used to create an angular bias. Accordingly, this specification and teaching is not intended to limit the variations to just the precise form describe herein.

FIG. 4 is a view similar to the structure of FIG. 3 now showing each cup 16 separated from the other. To help installation, each cup 16 can be placed on the breasts 14 individually and then the two-piece connector 38 fastened. Alternatively, the two-piece connector 38 could be a permanent connection and not come apart for ease of use.

Figure 5:
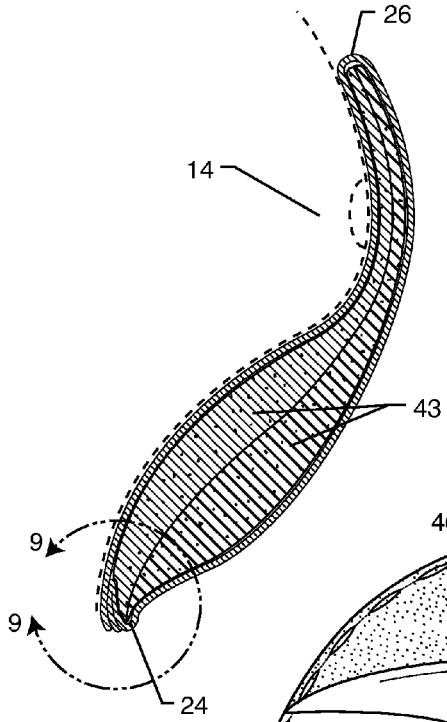
FIG. 5 is a cross-sectional view of the structure of FIG. 2 taken along line 5-5.

Also helping to provide support and facilitate positioning of the connector 38 at or below the bottom breast line 40, is the shelf-like padding 43 shown in FIG. 5. FIG. 5 is a cross-sectional view of the structure of FIG. 2 taken along line 5-5. The shelf-like padding 43 is disposed within each cup 16 adjacent to the bottom edge 24 and is generally disposed below the woman's breasts 14 when worn. The breasts 14 rest substantially above the padding 43 to help enhance the overall look for a bustier appearance. The padding 43 is thickest at its location just below the breast 14 and thins near the middle of the cup 16. Additionally, the padding 43 creates room to then position the connector 38 at or below the bottom breast line 40. The padding 43, the location of the connector 38, and the angular bias of the connector 38 all work together in unison to provide support for the breasts 14 and to create a superior bust line and cleavage appearance over the prior art.

Figure 6:
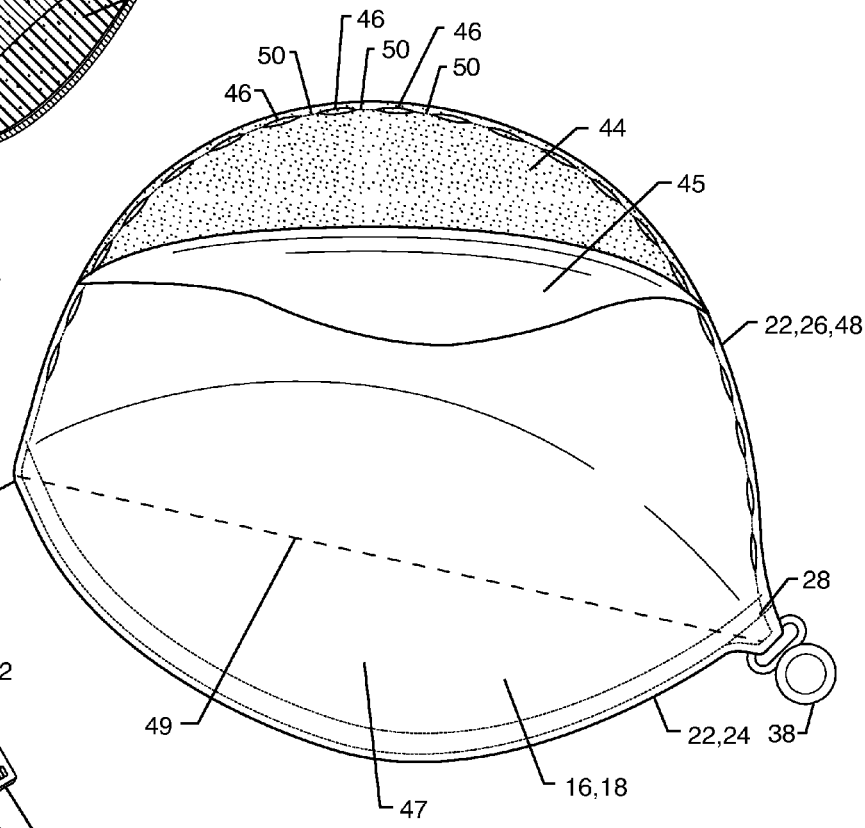
FIG. 6 is an inside view of the left cup of the structure of FIG. 2 showing an adhesive and a plurality of strap engagement receiving slots.

FIG. 6 is an inside view of the left cup 16 of the structure of FIG. 2. An adhesive 44 is disposed along a portion of the inside surface 18 of each cup 16 for removably adhering the bra 10 to a pair of woman's breasts 14 when worn. The adhesive 44 can be directly applied to the inside surface 18 of the bra 10 either during manufacture or at a later time directly before use. For instance, in one embodiment a spray-on adhesive may be utilized, or alternatively, a double-sided tape may be used to temporarily attach the bra 10 in position. As shown in FIG. 6, a thin film 45 can be placed over the adhesive 44 to keep it free from contamination while in storage, shipping, or when otherwise not being used.

A substantially flat inside surface area 47 of the bra can be defined which rests just below the woman's breast 14 when the bra 10 is in place. The area 47 is defined encompassing the area between the curved bottom edge 24 spanning the inner and outer peaks 28, 30 and between a straight line 49 drawn spanning the inner and outer peaks 28, 30. This straight line 49 coincides with the bottom breast line 40 when worn. The substantially flat area 47 forms a support below the woman's breast 14. The inward curve of the shelf-like padding 43 starts at the straight line 47, which padding 43 then thins as it reaches towards the curved top edge 26.

Figure 7:
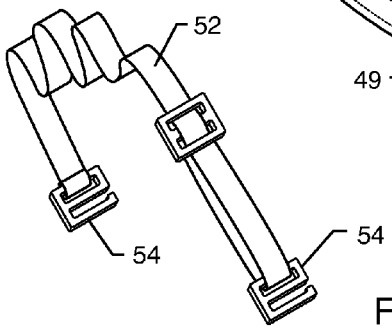
FIG. 7 is a perspective view of an exemplary strap which may be used with the exemplary adjustable push-up adhesive bra.

FIG. 6 also illustrates how in an exemplary embodiment the top edge 26 of each cup 16 comprises at least two strap engagement receiving slots 46. The at least two strap engagement receiving slots 46 can also be a plurality of strap engagement receiving slots 46. The plurality of strap engagement receiving slots 46 can be fashioned along the entire length of the top edge 26 such that they span from the outer peak 30 to the inner peak 28. The strap engagement receiving slots 46 can be formed by a selectively discontinuous upper seam 48 along the top edge 26. A stitch 50 is placed between open spaces of the slot 46 such that an adjustable-length strap 52 and hook feature 54 can be selectively positioned within. FIG. 7 shows one embodiment of such a strap 52 and its hook feature 54.

Figure 8:
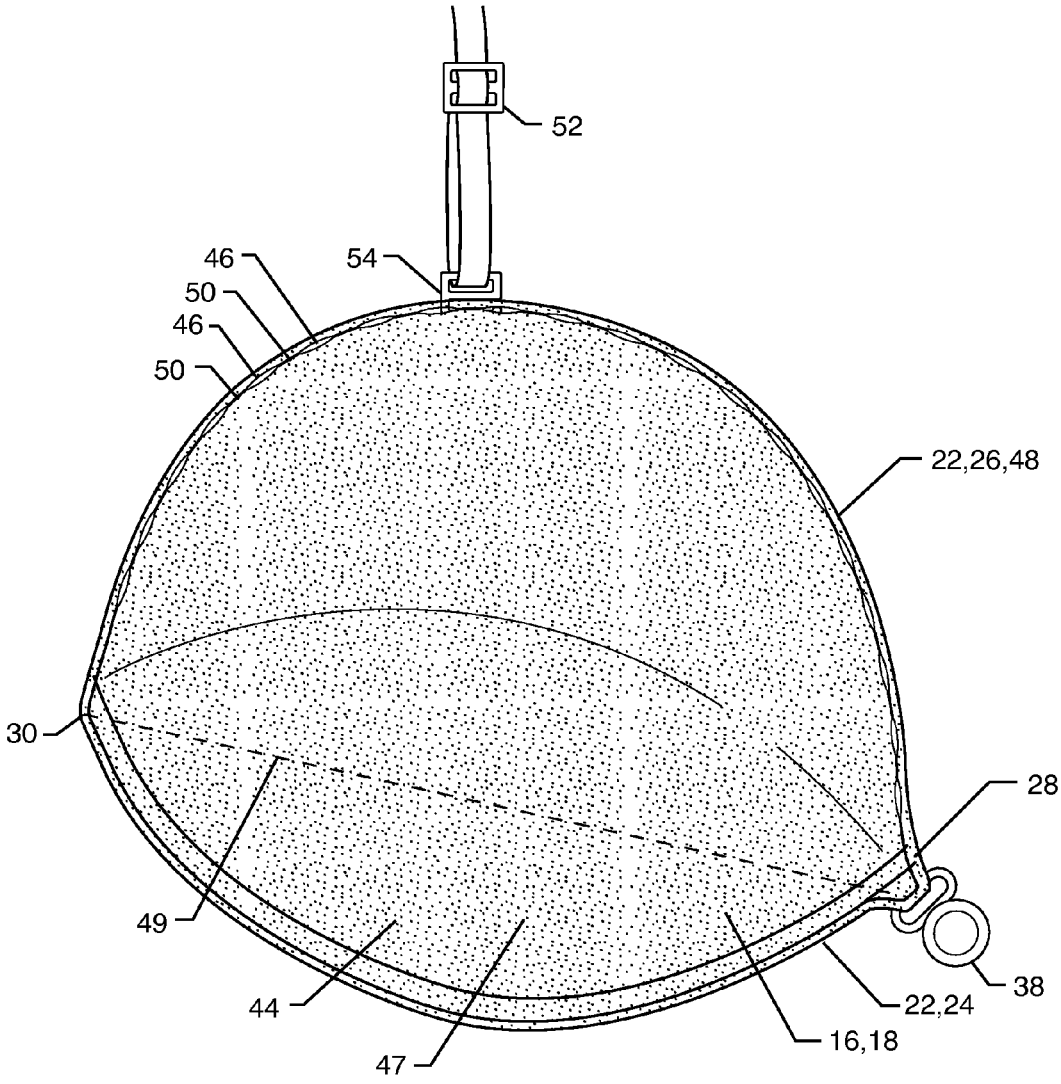
FIG. 8 is a view similar to structure of FIG. 6 now showing the strap connected.
Figure 10A:
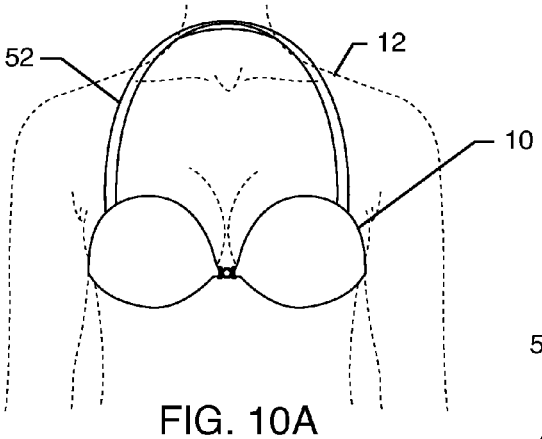
FIGS. 10A-E are front views of an exemplary adjustable push-up adhesive bra showing different strap variations.
Figure 10B:
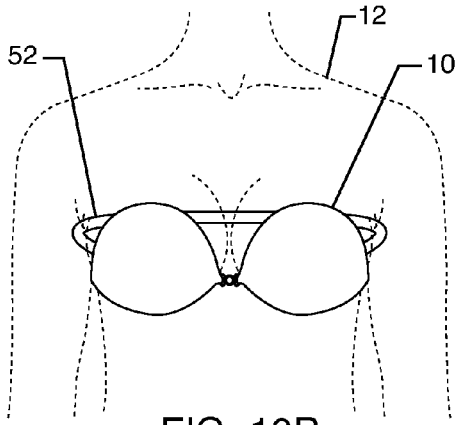
Figure 10C:
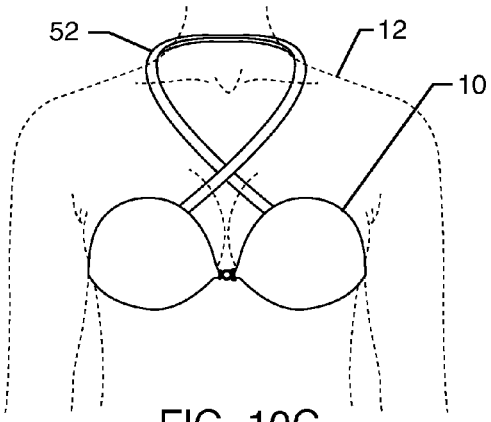
Figure 10D:
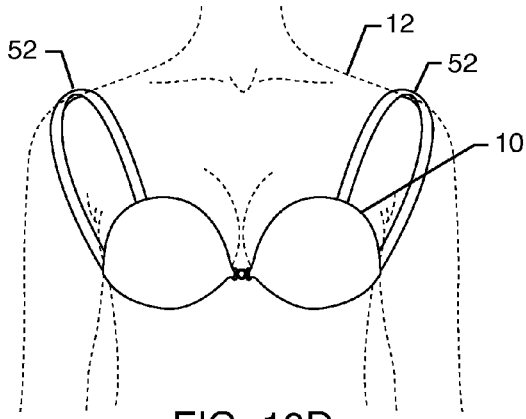
Figure 10E:
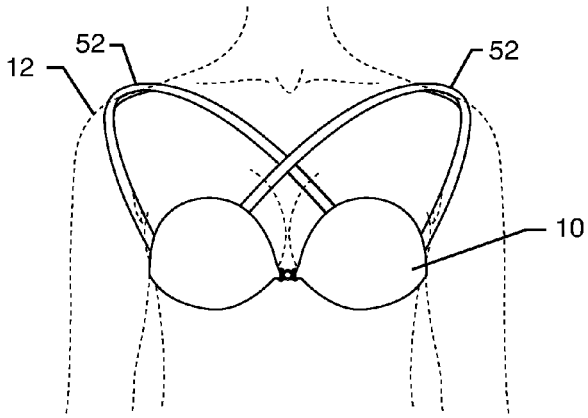

As shown in FIG. 8, the hook 54 can be slid within a particular slot and partially extended from an adjacent slot such that the strap 52 is secured to the top edge 26. This enables one to wear the push-up adhesive bra 10 in a plurality of methods and styles to match corresponding outfits or individual preferences. FIGS. 10A-E are front views of an exemplary adjustable push-up adhesive bra 10 showing different strap variations. FIG. 10A shows a single strap 52 connected to each cup 16 and passing around a woman's neck. FIG. 10B shows a single strap 52 connected to each cup 16 and passing below a woman's arm pit and around the back. FIG. 10C shows a single strap 52 connecting around the woman's neck with a cross-over twist in the front. FIG. 10D shows two straps 52 passing around each of the woman's shoulders. FIG. 10E shows two straps 52 connecting opposite cups 16 by crossing over in the front and then passing around to the back and underneath the arms. As can be seen, a multitude of strap 52 connection styles can be created and this specification is not intended to limit it to the precise forms described herein.

To keep a slim and sleek appearance at the top of the bra line, in an exemplary embodiment the top edge 26 can be no more than 3 mm in thickness. Similarly to keep a sleek appearance, the hook feature 54 of the strap 52 can be no more than 3 mm in thickness. For strength and support, the hook feature 54 of the strap 52 in a preferred embodiment can be metallic. However, it is to be understood that the hook feature 54 can be manufactured from a variety of materials such as plastic, and be fashioned in a multitude of shapes that allows it to easily connect to the various strap engagement receiving slots 46.

Figure 9:
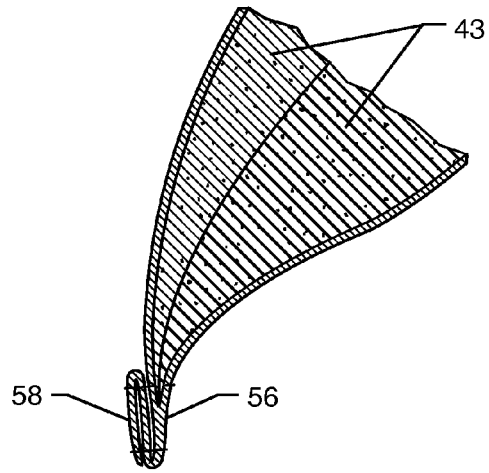
FIG. 9 is an enlarged cross-sectional view of the structure of FIG. 5 taken along line 9-9.

FIG. 9 is an enlarged cross-sectional view of the structure of FIG. 5 taken along line 9-9. In an exemplary embodiment, the bottom edge 24 of each cup 16 comprises a resiliently rigid seam 56. The resiliently rigid seam 56 can comprises a sewn overlapping fabric 58 which provides a resiliently rigid seam structure. The resiliently rigid seam 56 provides support without the use of an underwire. The resiliently rigid seam 56 helps to provide support to the adjustable push-up adhesive bra 10 to increase cleavage and the appearance of a fuller and larger bust.

Although several embodiments have been described in detail for purposes of illustration, various modifications may be made to each without departing from the scope and spirit of the invention. Accordingly, the invention is not to be limited, except as by the appended claims.

What is claimed is:

1. A bra, comprising:

a pair of bra cups, each cup comprising a generally concave inside surface opposite a generally convex outside surface where each cup defines a perimeter including a generally curved bottom edge and a generally curved top edge;

an adhesive disposed along a portion of the inside surface of each cup for removably adhering the bra to a pair of a woman's breasts when worn; and a two-piece connector comprising a first and second component, each component individually fixed to one bra cup and engagedly connecting the pair of cups thereby forming the bra, wherein the cups and connector are configured such that the connector is disposed substantially at or below a bottom breast line of the pair of woman's breasts when worn;

wherein the curved top edge of each cup comprises a plurality of strap engagement receiving slots, such that a strap is selectively attachable at one of the plurality of the strap engagement receiving slots.

2. The bra of claim 1, including a padding disposed within each cup adjacent to the bottom edge generally disposed below the woman's breasts when worn, such that the breasts rest substantially above the padding.

3. The bra of claim 1, wherein the connector engagedly connecting the pair of cups is resiliently and flexibly configured to angularly bias the cups to increase an angle between each curved top edge, such that when the bra is worn it forces each cup and corresponding breast in an upwardly and inwardly direction.

4. The bra of claim 1, wherein the connector is disposed at an intersection of the top edge and bottom edge wherein the connector is aligned with the top edge.

5. The bra of claim 1, wherein the bottom edge comprises a resiliently rigid seam.

6. The bra of claim 5, wherein the resiliently rigid seam comprises a sewn overlapping fabric.

7. The bra of claim 1, wherein the plurality of strap engagement receiving slots are formed by a selectively discontinuous upper seam along the top edge.

8. The bra of claim 7, wherein the top edge is no more than 3 mm in thickness.

9. The bra of claim 1, wherein the strap comprises a hook feature for engaging with the strap engagement receiving slots.

10. The bra of claim 9, wherein the hook feature of the strap is no more than 3mm in thickness.

11. The bra of claim 9, wherein the hook feature of the strap is metallic.

12. The bra of claim 2, wherein the curved top edge and curved bottom edge of each cup meet at an inner peak and an outer peak, where a straight line is defined spanning between the inner and outer peaks, and wherein a substantially flat inside area of the bra is disposed between the curved bottom edge and the straight line.

13. A bra, comprising:

a pair of bra cups, each cup comprising a generally concave inside surface opposite a generally convex outside surface where each cup generally defines an eye-shaped perimeter comprising a curved bottom edge and a curved top edge meeting at an inner peak and outer peak;

an adhesive disposed along a portion of the inside surface of each cup for removably adhering the bra to a pair of a woman's breasts when worn;

a connector individually fixed to each cup along the inner peak and engagedly connecting the pair of cups thereby forming the bra; and wherein the top edge of each cup comprises a plurality of strap engagement receiving slots, such that a strap is selectively attachable at one of the plurality of strap engagement receiving slots.

14. The bra of claim 13, wherein the cups and connector are configured such that the connector is disposed substantially at or below a bottom breast line of the pair of woman's breasts when worn.

15. The bra of claim 13, wherein the connector is resiliently and flexibly configured to angularly bias the cups to increase an angle between each curved top edge, such that when the bra is worn it forces each cup and corresponding breast in an upwardly and inwardly direction.

16. The bra of claim 13, including a padding disposed within each cup adjacent to the bottom edge generally disposed below the woman's breasts when worn, such that the breasts rest substantially above the padding.

17. The bra of claim 13, wherein the strap engagement receiving slots are formed by a selectively discontinuous upper seam along the top edge, wherein the top edge is no more than 3 mm in thickness, and wherein the strap comprises a hook feature for engaging with the strap engagement receiving slots.

18. The bra of claim 13, wherein the bottom edge comprises a resiliently rigid seam comprising a sewn overlapping fabric.

19. The bra of claim 13, wherein a straight line is defined spanning between the inner and outer peaks, and where a substantially flat inside area of the bra is disposed between the curved bottom edge and the straight line.

20. A bra, comprising:

a pair of bra cups, each cup comprising a generally concave inside surface opposite a generally convex outside surface where each cup defines a perimeter including a generally curved bottom edge and a generally curved top edge;

an adhesive disposed along a portion of the inside surface of each cup for removably adhering the bra to a pair of a woman's breasts when worn;

a two-piece connector comprising a first and second component, each component individually fixed to one bra cup and engagedly connecting the pair of cups thereby forming the bra, wherein the cups and connector are configured such that the connector is disposed substantially at or below a bottom breast line of the pair of woman's breasts when worn;

a padding disposed within each cup adjacent to the bottom edge generally disposed below the woman's breasts when worn, such that the breasts rest substantially above the padding; and wherein the top edge of each cup comprises a plurality of strap engagement receiving slots, such that a strap is selectively attachable at one of the plurality of the strap engagement receiving slots wherein the strap engagement receiving slots are formed by a selectively discontinuous upper seam along the top edge.

* * * * *